US010165645B2

(12) United States Patent
Tu et al.

(10) Patent No.: US 10,165,645 B2
(45) Date of Patent: Dec. 25, 2018

(54) LED LIGHTING MODULE HAVING TUNABLE CORRELATED COLOR TEMPERATURE AND CONTROL METHOD THEREOF

(71) Applicant: DELTA ELECTRONICS, INC., Taoyuan Hsien (TW)

(72) Inventors: Kuan-Hsien Tu, Taoyuan Hsien (TW); Ying-Hao Huang, Taoyuan Hsien (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 0 days.

(21) Appl. No.: 15/783,241

(22) Filed: Oct. 13, 2017

(65) Prior Publication Data

US 2018/0042082 A1 Feb. 8, 2018

Related U.S. Application Data

(63) Continuation of application No. 15/188,400, filed on Jun. 21, 2016, now abandoned.

(60) Provisional application No. 62/188,095, filed on Jul. 2, 2015.

(51) Int. Cl.
*H05B 33/08* (2006.01)

(52) U.S. Cl.
CPC ..... *H05B 33/0857* (2013.01); *H05B 33/083* (2013.01); *H05B 33/086* (2013.01)

(58) Field of Classification Search
CPC ..... H05B 33/0857; H05B 33/086
USPC ..... 315/185 R, 194, 291, 308
See application file for complete search history.

(56) References Cited

U.S. PATENT DOCUMENTS

2014/0252967 A1* 9/2014 van de Ven ..... H05B 33/0863 315/188
2015/0230305 A1* 8/2015 Yoon ..... H05B 33/0821 315/297

* cited by examiner

*Primary Examiner* — Thuy Vinh Tran
(74) *Attorney, Agent, or Firm* — Kirton McConkie; Evan R. Witt

(57) ABSTRACT

An LED lighting module comprises a plurality of serially-connected LED strings, which include N LED strings from a first LED string to an Nth LED string, and each LED string has a specific driven voltage. The control method comprises steps of: (a) receiving an AC voltage signal and converting the AC input signal into a first AC signal; (b) receiving the first AC signal and converting the first AC signal into a first DC signal; and (c) if the first DC signal exceeds the sum of the driven voltages from the first LED string to an nth LED string, driving the serially-connected LED strings from the first LED string to the nth LED string sequentially, wherein n is smaller than or equal to N, so as to adjust the correlated color temperature of the light emitted by the LED lighting module.

15 Claims, 12 Drawing Sheets

LED LIGHTING MODULE HAVING TUNABLE CORRELATED COLOR TEMPERATURE AND CONTROL METHOD THEREOF

CROSS-REFERENCE TO RELATED APPLICATION

This application is a Continuation Application of U.S. patent application Ser. No. 15/188,400 filed on Jun. 21, 2016 and entitled "LED LIGHTING MODULE HAVING TUNABLE CORRELATED COLOR TEMPERATURE AND CONTROL METHOD THEREOF", which claims priority to U.S. Provisional Application Ser. No. 62/188,095 filed on Jul. 2, 2015 and entitled "TUNABLE CORRELATED COLOR TEMPERATURE LED LIGHTING MODULE", the entirety of which is hereby incorporated by reference.

FIELD OF THE INVENTION

The present invention relates to an LED lighting module, and more particularly to an LED lighting module having tunable correlated color temperature and control method thereof.

Since LED element has advantages of low power consumption, high light intensity, long operational life and low cost, the LED element is widely used in various lighting modules. At present, related applications of the LED lighting modules are developed quickly. Some characteristics of the light emitted from the LED lighting modules are important and need to be taken into consideration. For example, correlated color temperature (CCT) is an indication of the color appearance of the light emitted by a light source, relating its color to the color of light from a reference light source when heated to a particular temperature. Typically, lighting sources with CCT values below 3000K are considered as "warm" light sources, while those with CCT values above 4000K are considered as "cool" light sources. However, there are some challenges to control and adjust the color temperature and intensity of the LED lighting module.

An LED lighting fixture having adjustable color temperature has been disclosed in U.S. Pat. No. 7,014,336 by Alfred D. Ducharme et al.. The LED lighting fixture of Alfred D. Ducharme et al. includes a processor and a collection of component illumination sources. The collection of component illumination sources is an array of LEDs. The collection of component illumination sources comprises at least two illumination sources that produce different spectrums of light. The collection of component illumination sources is arranged within the lighting fixture on a mounting in such a way that the light emitted from the different component illumination sources is allowed to mix to produce a resultant spectrum of light which is basically the additive spectrum of the different component illumination sources. The collection of illumination sources is controlled by the processor to produce controlled illumination. However, a processor capable of communicating with the plural LEDs and controlling the intensity of the plural LEDs needs to be employed. The processor is complicated and high-cost.

At present, most LED lighting modules not only employ processors to control and adjust the correlated color temperature and the intensity but also increase the demand in the control fineness. Consequently, the processors should be designed with complex, and the cost of production will be increased.

Therefore, there is a need of providing an LED lighting module having tunable correlated color temperature and control method in order to eliminate the above drawbacks.

SUMMARY OF THE INVENTION

The present invention provides an LED lighting module having tunable correlated color temperature and a control method thereof. By using the inventive LED lighting module, there is no need to employ a complicated and high-cost processor to control the LED strings, so that the cost of production is decreased. In addition, the inventive LED lighting module is dimmable and the color temperature of the light emitted by the inventive LED lighting module is adjusted by controlling the current to flow through the LED strings according to the comparing results between the line voltage and the reference voltages. Consequently, the circuit topology and the control method of the inventive LED lighting module are simple and applicable for various indoor lighting fixtures. Furthermore, the plural LED strings having at least two different predetermined correlated color temperature values are disposed on the surface of the circuit board with symmetrical and interspersed arrangement, so that the light emitted by the LED lighting module is more uniform.

In accordance with one aspect of the present invention, an LED lighting module having tunable correlated color temperature is provided and comprises a dimmer unit, a rectifier unit, a control unit and an LED lighting unit. The dimmer unit is configured to receive an AC input signal and convert the AC input signal into a first AC signal. The rectifier unit is electrically connected with an output of the dimmer unit and configured to receive the first AC signal and convert the first AC signal into a first DC signal. The LED lighting unit is electrically connected with the rectifier unit and configured to receive the first DC signal, wherein the LED lighting unit comprises a plurality of serially-connected LED strings, each of the LED strings has a predetermined correlated color temperature, and the plurality of LED strings have at least two different correlated color temperatures. The plurality of LED strings include N LED strings from a first LED string to an Nth LED string, N is a positive integer greater than 2, and each of N LED strings has a specific driven voltage. The control unit is electrically connected with the rectifier unit, the LED lighting unit and a ground point, and configured to receive the first DC signal and control current flowing through the plurality of LED strings according to the first DC signal. If the first DC signal exceeds the sum of the driven voltages from the first LED string to an nth LED string, the serially-connected LED strings are driven from the first LED string to the nth LED string sequentially, wherein n is smaller than or equal to N, so as to adjust the correlated color temperature of the light emitted by the LED lighting module.

In accordance with another aspect of the present invention, a control method for performing a correlated color temperature adjustment of an LED lighting module is disclosed. The LED lighting module comprises a dimmer unit, a rectifier unit, a control unit and an LED lighting unit, the LED lighting unit includes a plurality of serially-connected LED strings, each of the LED strings has a predetermined correlated color temperature, and the plurality of LED strings have at least two different correlated color temperatures. The plurality of LED strings include N LED strings from a first LED string to an Nth LED string, N is a positive integer greater than 2, and each of N LED strings has a specific driven voltage. The control method comprises steps of: (a) receiving an AC voltage signal and converting the AC input signal into a first AC signal by the dimmer unit; (b) receiving the first AC signal and converting the first AC signal into a first DC signal by the rectifier unit; and (c) if the first DC signal exceeds the sum of the driven voltages from the first LED string to an nth LED string, driving the serially-connected LED strings from the first LED string to the nth LED string sequentially, wherein n is smaller than or equal to N, so as to adjust the correlated color temperature of the light emitted by the LED lighting module.

DESCRIPTION OF THE PREFERRED EMBODIMENT

An exemplary embodiment embodying the features and advantages of this embodiment will be expounded in following paragraphs of descriptions. It is to be realized that the present invention is allowed to have various modification in different respects, all of which are without departing from the scope of the present invention, and the description herein and the drawings are to be taken as illustrative in nature, but not to be taken as a confinement for this embodiment.

Figure 1:
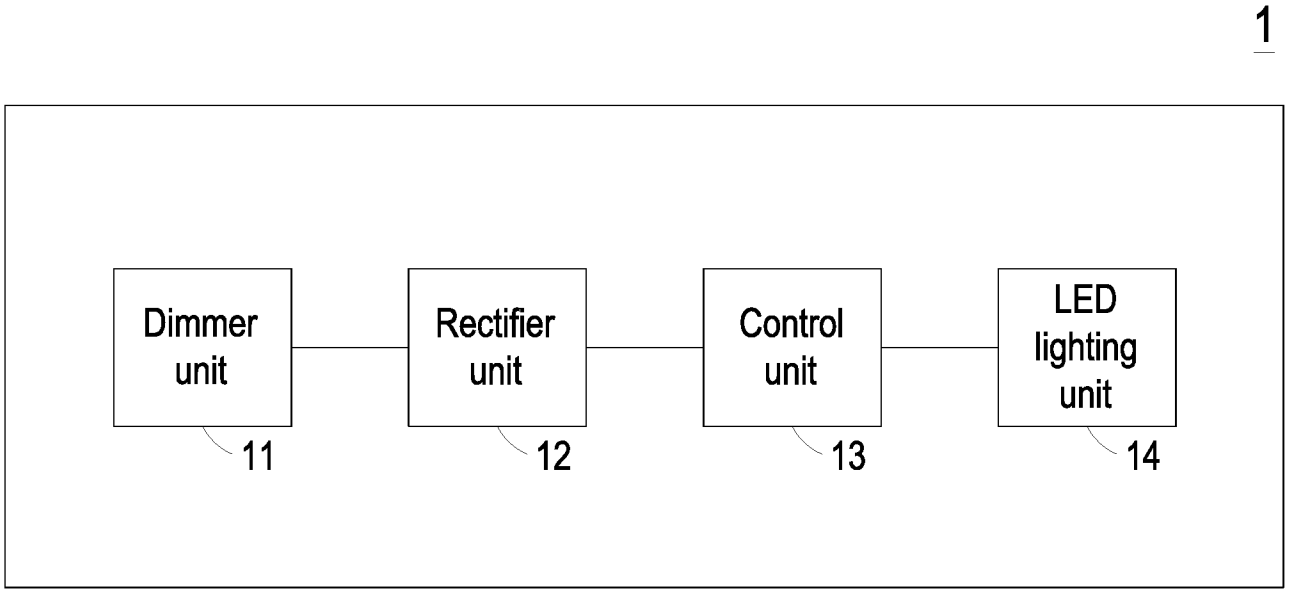
FIG. 1 is a circuit block diagram illustrating an LED lighting module having tunable correlated color temperature according to an embodiment of the present invention.
Figure 2:
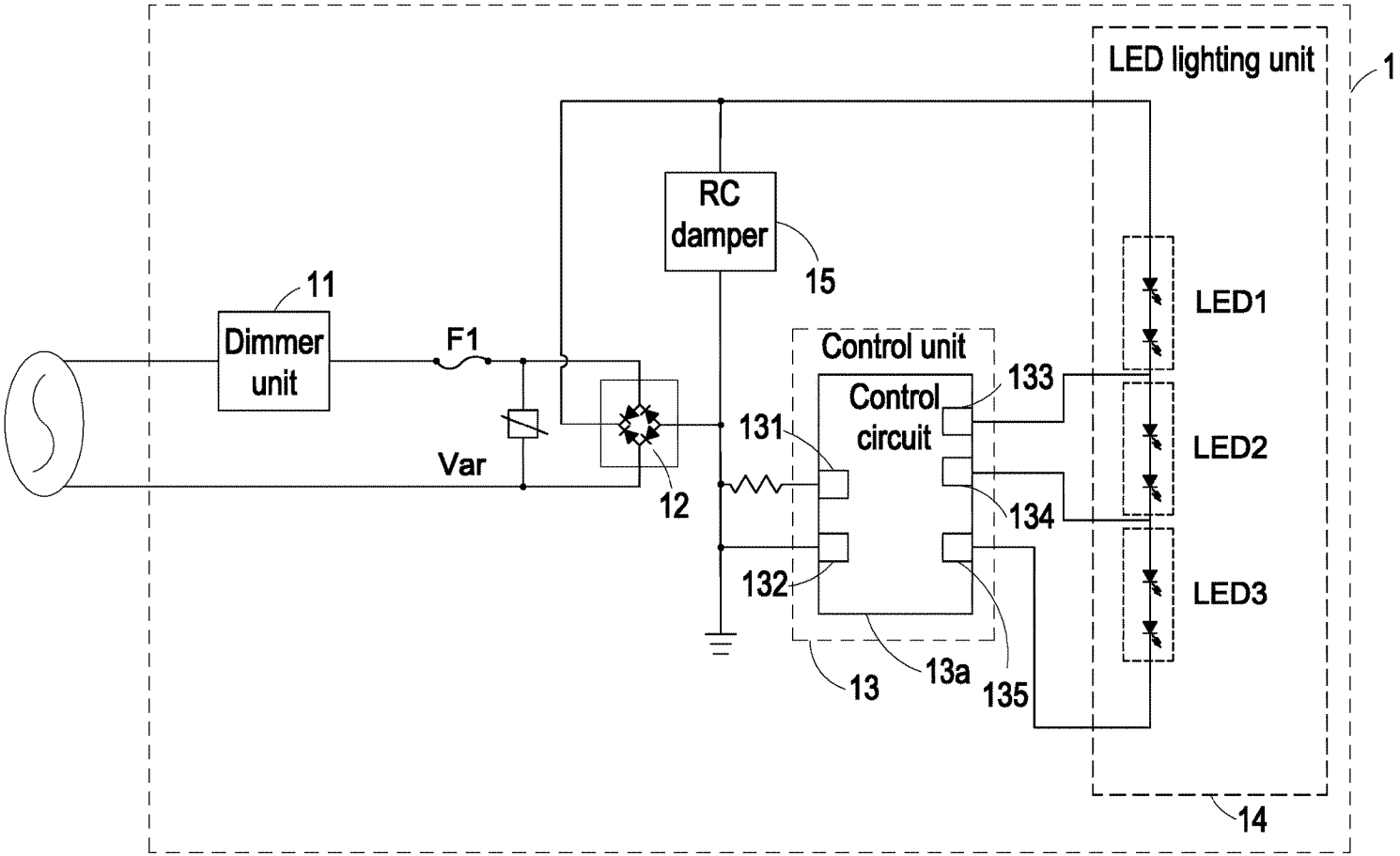
FIG. 2 is a schematic diagram showing an exemplary circuit topology of the LED lighting module of FIG. 1.
Figure 3:
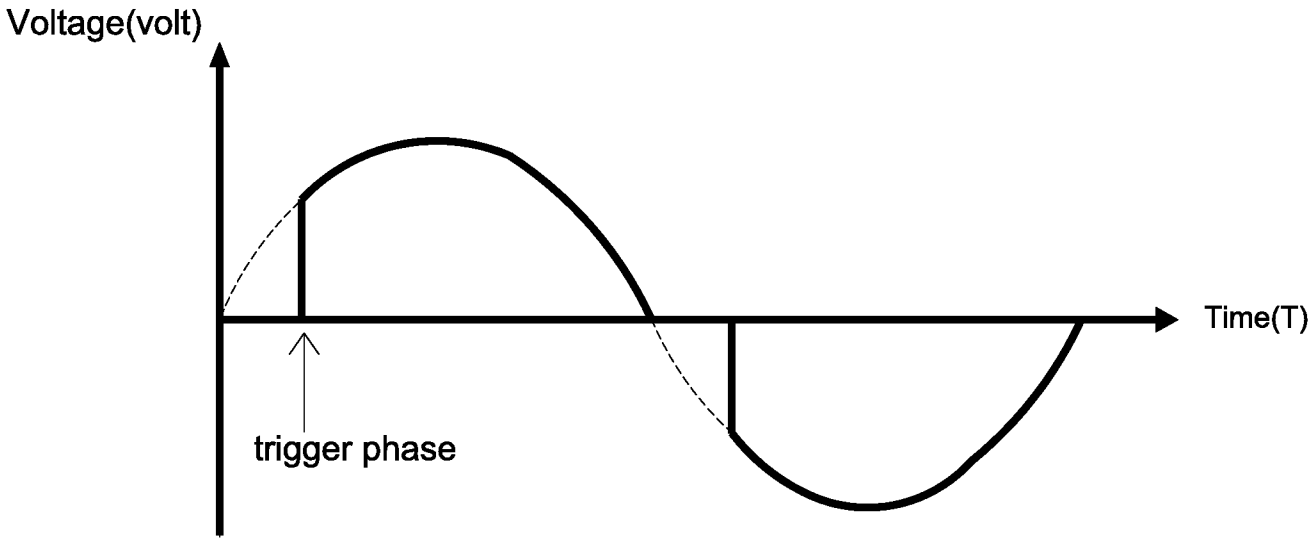
FIG. 3 shows the waveform of the first AC signal generated by the dimmer unit of the LED lighting module of FIG. 1.

FIG. 1 is a circuit block diagram illustrating an LED lighting module having tunable correlated color temperature according to an embodiment of the present invention, and FIG. 2 is a schematic diagram showing an exemplary circuit topology of the LED lighting module of FIG. 1. As shown in FIGS. 1 and 2, the LED lighting module having tunable correlated color temperature 1 (hereinafter also referring to as LED lighting module 1) comprises a dimmer unit 11, a rectifier unit 12, a control unit 13 and an LED lighting unit 14. The dimmer unit 11 is configured to receive an AC input signal from an AC power source and convert the AC input signal into a first AC signal. In an embodiment, the dimmer unit 11 includes a TRIAC circuit. Preferably but not exclusively, the TRIAC circuit includes a tri-electrode AC switch. FIG. 3 shows the waveform of the first AC signal generated by the dimmer unit of the LED lighting module of FIG. 1, where solid line indicates the first AC signal generated by the dimmer unit 11. As shown in FIGS. 2 and 3, the dimmer unit 11 receives the AC input signal, and when the AC input signal exceeds a trigger phase, a TRIAC circuit in the dimmer unit 11 is triggered to turn on and generates a phase-cut AC signal (i.e. the first AC signal).

In some embodiments, the LED lighting module 1 includes a fuse F1 electrically connected between the dimmer unit 11 and the rectifier unit 12. The AC current flows across the fuse F1 prior to entering the rectifier unit 12. The fuse F1 is configured to interrupt the current in case of overcurrents. A surge protection unit Var is electrically connected between the dimmer unit 11 and the rectifier unit 12 and configured to reduce or eliminate transmission of voltage transients exceeding the line voltage provided to the LED strings of the LED lighting unit 14.

The rectifier unit 12 is electrically connected with an output of the dimmer unit 11 and configured to receive the first AC signal and convert the first AC signal into a first DC signal. In an embodiment, the rectifier unit 12 includes a full-bridge circuit having four diodes. In some embodiments, a RC damper 15 is electrically connected with the output of rectifier unit 12 for reducing the current concussion.

The LED lighting unit 14 is electrically connected with the rectifier unit 12 and the control unit 13 and configured to receive the first DC signal. The LED lighting unit 14 includes a plurality of LED strings LED 1 to LED N, where N is a positive integer greater than 2. Each of the LED strings LED 1, LED 2, . . . , LED N has a predetermined correlated color temperature value. The plural LED strings LED 1, LED 2, . . . , LED N have at least two different correlated color temperature values. In an embodiment, the LED lighting unit 14 comprises three LED strings including first LED string LED 1, second LED string LED 2 and third LED string LED 3. Although three LED strings are shown for illustration purposes in FIG. 2, more or less than three LED strings can be provided in per LED lighting module 1. The three LED strings are electrically connected in series in order from the first LED string LED 1 to the third LED string LED 3. Each of the LED strings has a predetermined correlated color temperature value, and the three LED strings have at least two different correlated color temperature values. Preferably, each of the LED strings has respective correlated color temperature value different with that of other LED strings. In addition, each of the LED strings has a specific driven voltage. Each of the LED strings includes a plurality of LED elements, where the LED elements of respective LED string have at least two different correlated color temperature values. The predetermined correlated color temperature value of respective LED string can be generated by mixing the colors of the light emitted by the LED elements having at least two different correlated color temperature values.

In this embodiment, the control unit 13 is a centralized control architecture. The control unit 13 comprises a control circuit 13*a*. The control circuit 13*a* is electrically connected with the rectifier unit 12, the LED lighting unit 14 and a ground point G and configured to receive the first DC signal and control the current flowing through the LED strings LED 1, LED 2, . . . , LED N according to the comparing results between the first DC signal with N reference voltages, where the Nth reference voltage is the sum of the driven voltages from the first LED string LED 1 to the Nth LED strings LED N. For example, the first reference voltage is equal to the driven voltage of the first LED string LED 1, the second reference voltage is equal to the sum of the driven voltages from the first LED string LED 1 to the second LED string LED 2, and the third reference voltage is equal to the sum of the driven voltages from the first LED string LED 1 to the third LED string LED 3. In this embodiment, the third reference voltage is larger than the second reference voltage, and the second reference voltage is larger than the first reference voltage, but it is not limited thereto. If the first DC signal received by the control circuit 13*a* exceeds one of the N reference voltages, the corresponding LED string or the corresponding serially-connected LED strings can be driven to light up and generate a specific correlated color temperature value. For example, if the first DC signal received by the control circuit 13*a* exceeds the first reference voltage, the first LED string LED 1 can be driven to light up. Namely, the control circuit 13*a* controls the current flowing through the first LED string LED 1. If the first DC signal received by the control circuit 13*a* exceeds the second reference voltage, the first LED string LED 1 and the second LED string LED 2 connected in series can be driven to light up. Namely, the control circuit 13*a* controls the current flowing through the first LED string LED 1 and the second LED string LED 2. If the first DC signal received by the control circuit 13*a* exceeds the third reference voltage, the first LED string LED 1, the second LED string LED 2 and the third LED string LED 3 connected in series can be driven to light up. Namely, the control circuit 13*a* controls the current flowing through the first LED string LED 1, the second LED string LED 2 and the third LED string LED 3.

In some embodiments, the control circuit 13*a* supplies variable amounts of current to at least one of the LED strings and make the intensity of the at least one LED string variable. The intensity of the LED string or the intensity of the serially-connected LED strings is in directly proportional to the current flowing through the corresponding LED string or the corresponding serially-connected LED strings.

The control circuit 13*a* comprises an output channel 131, a ground channel 132 and N driving channels. The output channel 131 is electrically connected with the output of the rectifier unit 12 and configured to output the first DC signal from the control circuit 13*a*. The ground channel 132 is electrically connected with the ground. The Nth driving channel is configured to drive the first LED string LED 1 to the Nth LED string LED N. In some embodiments, N driving channels includes for example but not limited to three driving channels. The three driving channels include first driving channel 133, second driving channel 134 and third driving channel 135, which are electrically connected with a first node between the first LED string LED 1 and the second LED string LED 2, a second node between the second LED string LED 2 and the third LED string LED 3, and one terminal of the third LED string LED 3, respectively. The first driving channel 133 is configured to drive the first LED strings LED 1, the second driving channel 134 is configured to drive the first LED string LED 1 and the second LED string LED 2 connected in series, and the third driving channel 135 is configured to drive the first LED string LED 1, the second LED string LED 2 and the third LED string LED 3 connected in series. The control circuit 13*a* is configured to compare the first DC signal with N reference voltages and control the current flowing through the LED strings according to the comparing results between the first DC signal and N reference voltages. The Nth reference voltage is the sum of the driven voltages from the first LED string LED 1 to the Nth LED string LED N. If the first DC signal exceeds the first reference voltage, the first driving channel 133 is enabled to drive the first LED string LED 1 by the first DC signal. If the first DC signal exceeds the second reference voltage, the second driving channel 134 is enabled to drive the first LED string LED 1 and the second LED string LED 2 connected in series by the first DC signal. If the first DC signal exceeds the third reference voltage, the third driving channel 135 is enabled to drive the first LED string LED 1, the second LED string LED 2 and the third LED string LED 3 connected in series by the first DC signal.

Figure 4:
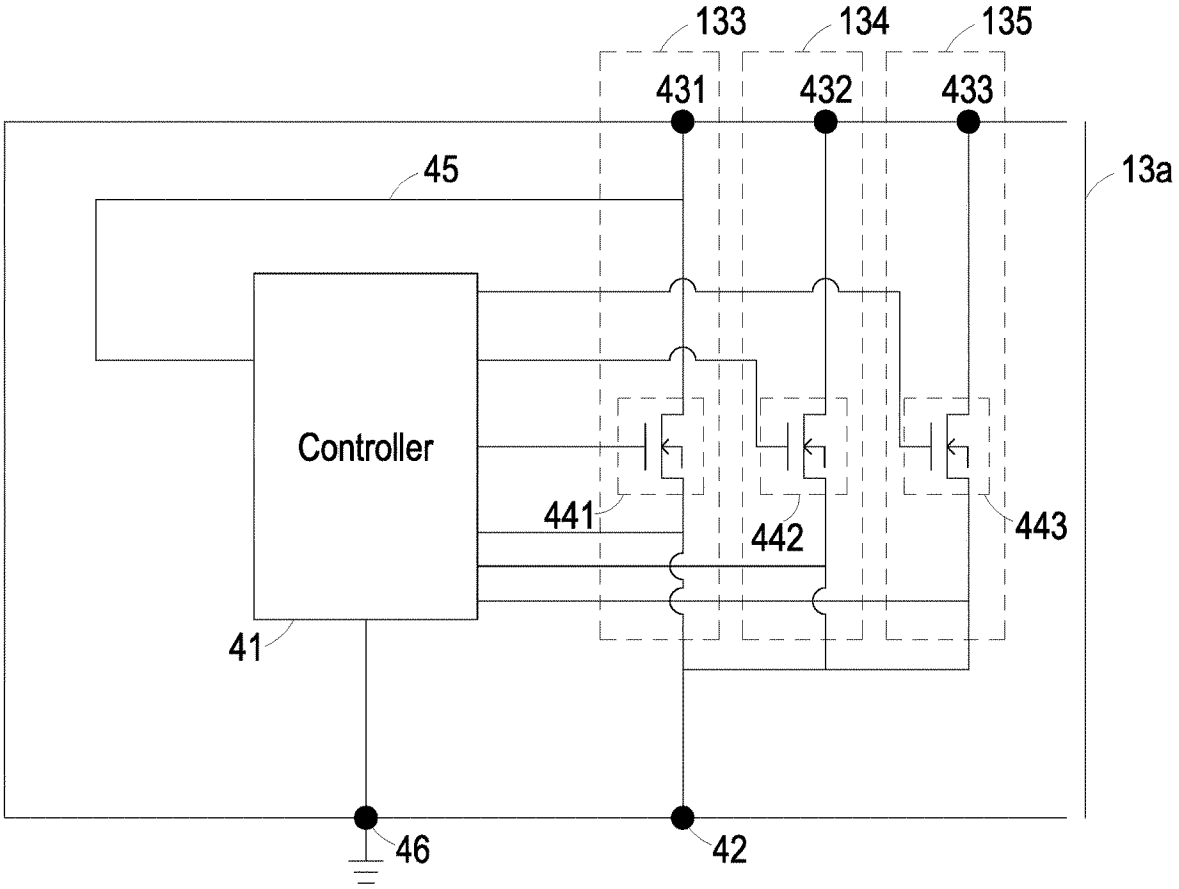
FIG. 4 is a circuit block diagram illustrating an example of the control circuit of FIG. 2.

FIG. 4 is a circuit block diagram illustrating an example of the control circuit of FIG. 2. As shown in FIGS. 2 and 4, the control circuit 13*a* comprises a controller 41, an output terminal 42, three driving terminals 431, 432, 433, three switches 441, 442, 443 and a ground point 46. The first driving channel 133 comprises the first driving terminal 431 and the first switch 441, the second driving channel 134 comprises the second driving terminal 432 and the second switch 442, and the third driving channel 135 comprises the third driving terminal 433 and the third switch 443. The output channel 131 is the output terminal 42. The ground channel 132 is the ground point 46. In this embodiment, the first driving terminal 431 is connected to the drain of the first switch 441, the second driving terminal 432 is connected to the drain of the second switch 442, and the third driving terminal 433 is connected to the drain of the third switch 443. The gate of the first switch 441 is connected to the controller 41 and the source of the first switch 441 is connected to the output terminal 42, the gate of the second switch 442 is connected to the controller 41 and the source of the second switch 442 is connected to the output terminal 42, and the gate of the third switch 443 is connected to the controller 41 and the source of the third switch 443 is connected to the output terminal 42. Preferably, the first switch 441, the second switch 442 and the third switch 443 are MOSFET switches. A branch 45 is electrically connected with the first driving terminal 431 and the controller 41 so that the first DC voltage is provided to the controller 41. The ground point 46 is connected to the controller 41.

The controller 41 compares the first DC signal with the reference voltages. If the first DC signal exceeds the first reference voltage, the controller 41 drives the first switch 441 for allowing the first DC signal to flow from the first driving terminal 431 to the output terminal 42 so as to drive the first LED string LED 1. If the first DC signal exceeds the second reference voltage, the controller 41 drives the second witch 442 for allowing the first DC signal to flow from the second driving terminal 432 to the output terminal 42 so as to drive the first LED string LED 1 and the second LED string LED 2 connected in series. If the first DC signal exceeds the third reference voltage, the controller 41 drives the third switch 443 for allowing the first DC signal to flow from the third driving terminal 433 to the output terminal 42 so as to drive the first LED string LED 1, the second LED string LED 2 and the third LED string LED 3 connected in series.

Due to that the first LED string LED 1, the second LED string LED 2 and the third LED string LED 3 have at least two different correlated color temperature values, the correlated color temperature of the light emitted by the LED lighting module 1 can be generated by mixing the light emitted by the driven LED strings having at least two different correlated color temperature values.

Figure 5:
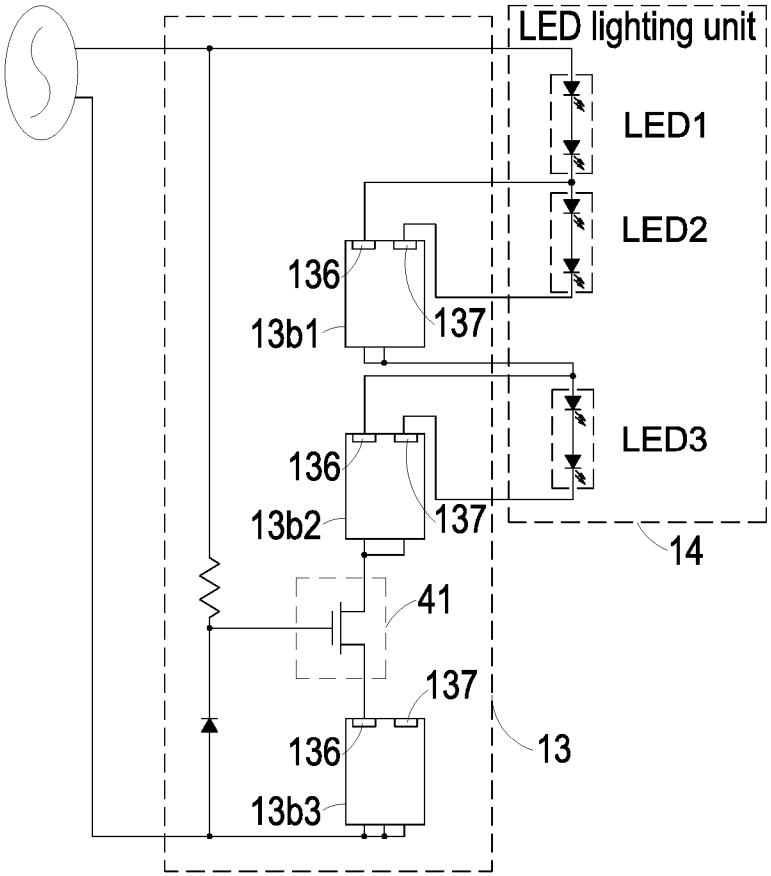
FIG. 5 is a schematic diagram showing another exemplary circuit topology of the LED lighting module of FIG. 1.

FIG. 5 is a circuit diagram illustrating another circuit topology of the LED lighting module of FIG. 1. In this embodiment, the control unit 13 is a distributed control architecture. The control unit 13 comprises for example but not limited to N control circuits 13*b*1 to 13*bn* and a switch circuit 41. The first DC signal drives the switch circuit 41 for allowing the first DC signal to flow from the first control circuit 13*b*1 to the Nth control circuit 13*bn*. The control circuits 13*b*1 to 13*bn* control the current flowing through the LED strings according to the comparing results between the first DC signal with N reference voltages, where the Nth reference voltage is the sum of the driven voltages from the first LED string LED 1 to the Nth LED strings LED N. For example, the first reference voltage is equal to the driven voltage of the first LED string LED 1, the second reference voltage is equal to the sum of the driven voltages from the first LED string LED 1 to the second LED string LED 2, and the third reference voltage is equal to the sum of the driven voltages from the first LED string LED 1 to the third LED string LED 3. In this embodiment, the third reference voltage is larger than the second reference voltage, and the second reference voltage is larger than the first reference voltage, but it is not limited thereto.

Each of the control circuits 13*b*1 to 13*bn* comprises a first driving channel 136, a second driving channel 137 and an output channel. In a case that N is equal to 2, the first driving channel 136 of the first control circuit 13*b*1 is electrically connected to a node between the first LED string LED 1 and the second LED string LED 2, and the second driving channel 137 of the first control circuit 13*b*1 is electrically connected to one terminal of the second LED string LED 2. The first driving channel 136 of the second control circuit 13*b*2 is electrically connected to the first control circuit 13*b*1 through the switch circuit 41. In a case that N is larger than 2, the first driving channel 136 of the first control circuit 13*b*1 is electrically connected to a node between the first LED string LED 1 and the second LED string LED 2, and the second driving channel 137 of the first control circuit 13*b*1 is electrically connected to one terminal of the second LED string LED 2. The first driving channel 136 of the second control circuit 13*b*2 is electrically connected to the output channel of the first control circuit 13*b*1 and one terminal of the third LED string LED 3, and the second driving channel 137 of the second control circuit 13*b*2 is electrically connected to the other terminal of the third LED string LED 3. The first driving channel 136 of the (N−1)th control circuit 13*b*(n−1) is electrically connected to the output channel of the (N−2)th control circuit 13*b*(n−2) and one terminal of the Nth LED string LED N, and the second driving channel 137 of the (N−1)th control circuit 13*b*2 is electrically connected to the other terminal of the Nth LED string LED N. The first driving channel 136 of the Nth control circuit 13*bn* is electrically connected to the output channel of the (N−1)th control circuit 13*b*(n−1) through the switch circuit 41.

If the first DC signal exceeds the first reference voltage, the first driving channel 136 of the first control circuit 13*b*1 is enabled to drive the first LED string LED 1. If the first DC signal exceeds the second reference voltage, the first driving channel 136 of the second control circuit 13*b*2 is enabled to drive the first LED string LED 1 to the second LED string LED 2 through the second driving channel 137 of the first control circuit 13*b*1. If the first DC signal exceeds the Nth reference voltage, the first driving channel 136 of the Nth control circuit 13*bn* is enabled to drive the first LED string LED 1 to the Nth LED string LED N through the second driving channel 137 of the (N−1)th control circuit 13*b*(n−1).

Referring to FIG. 5 again, in this embodiment, N is equal to three. The first driving channel 136 of the first control circuit 13*b*1 is electrically connected to the first LED string LED 1 and the second driving channel 137 of the first control circuit 13*b*1 is electrically connected to the second LED string LED 2. The first driving channel 136 of the second control circuit 13*b*2 is electrically connected to the output channel of the first control circuit 13*b*1 and one terminal of the third LED string LED 3, and the second driving channel 137 of the second control circuit 13*b*2 is electrically connected to the other terminal of the third LED string LED 3. The first driving channel 136 of the third control circuit 13*b*3 is electrically connected to the output channel of the second control circuit 13*b*2 through the switch circuit 41. After the first DC signal drives the switch circuit 41 for allowing the first DC signal to flow from the first control circuit 13*b*1 to the third control circuit 13*b*3, the control circuits 13*b*1 to 13*b*3 compare the first DC signal with respective reference voltages. The Nth reference voltage is the sum of the driven voltages from the first LED string LED 1 to the Nth LED string LED N. If the first DC signal exceeds the first reference voltage, the first driving channel 136 of the first control circuit 13*b*1 is enabled to drive the first LED string LED 1 by the first DC signal. If the first DC signal exceeds the second reference voltage, the first driving channel 136 of the second control circuit 13*b*2 is enabled to drive the first LED string LED 1 and the second LED string LED 2 through the second driving channel 137 of the first control circuit 13*b*1 by the first DC signal. If the first DC signal exceeds the third reference voltage, the first driving channel 136 of the third control circuit 13*b*3 is enabled to drive the first LED string LED 1, the second LED string LED 2 and the third LED string LED 3 through the second driving channel 137 of the first control circuit 13*b*1 and the second driving channel 137 of the second control circuit 13*b*2 by the first DC signal.

In the LED lighting module 1 of the present invention, the dimmer unit 11 is employed to adjust the duty of the waveform, and the phase-cut waveform is used to drive the LED string directly. Consequently, there is no need to add addition circuit to filter the ripple or use complex circuits or processors to output a signal with specific voltage level to drive the specific LED string.

Figure 6:
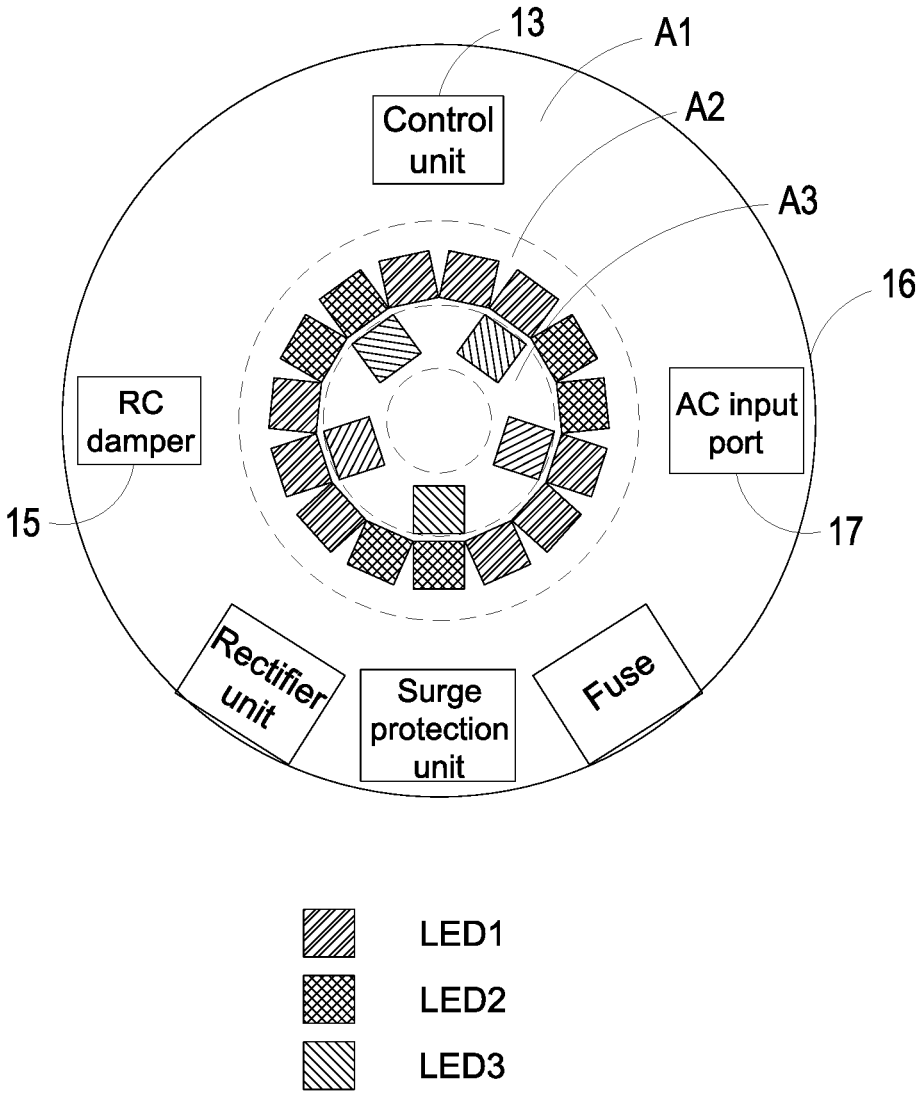
FIG. 6 is a schematic view illustrating an exemplary arrangement of the circuit units and the LED strings of the LED lighting module of FIG. 1.

FIG. 6 is a schematic view illustrating an exemplary arrangement of the circuit units and the LED strings of the LED lighting module of FIG. 1. As shown in FIGS. 2 and 6, in some embodiments, the LED lighting module 1 comprises a circuit board 16. The rectifier unit 12, the control unit 13, the LED lighting unit 14, the fuse F1, the surge protection unit Var, the RC damper 15 and an AC input port 17 are disposed on the circuit board 16. In addition, the first LED string LED 1, the second LED string LED 2 and the third LED string LED 3 have different correlated color temperature values and are disposed on the same surface of the circuit board 16 with symmetrical and interspersed arrangement. In an embodiment, the surface of the circuit board 16 is divided into three areas including first ring area A1, second ring area A2 and third ring area A3. The third ring area A3, the second ring area A2, and the first ring area A1 are co-axial and sequentially arranged along the radial direction from the center to outside. The rectifier unit 12, the control unit 13, the surge protection unit Var, the fuse F1 , the RC damper 15 and the AC input port 17 are disposed on the first ring area A1 and spaced apart with each other. The first LED string LED 1 including at least nine LED elements and the second LED string LED 2 including at least six LED elements are disposed on the second ring area A2 and spaced apart with each other. The third LED string LED 3 includes at least four LED elements disposed on the third ring area A3 and spaced apart with each other. Preferably, the nine LED elements of the first LED string LED 1 are divided into three groups, and the six LED elements of the second LED string LED 2 are divided into three groups. More preferably, the three groups of the LED elements of the first LED string LED 1 and the three groups of the LED elements of the second LED string LED 2 are alternately arranged on the second ring area A2. Due to that the first LED string LED 1, the second LED string LED 2 and the third LED string LED 3 are disposed on the surface of the circuit board 16 with symmetrical and interspersed arrangement, the light emitted by the LED lighting module 1 is more uniform. In an embodiment, there are N LED strings disposed on the same surface of the circuit board 16, wherein the circuit board 16 are divided into a first ring area A1, a second ring area A2 and a third ring area A3. The rectifier unit 12 and the control unit 13 are disposed on the first ring area A1, at least one LED string of the N LED strings is disposed on the third ring area A3, and the other LED strings of the N LED strings are disposed on the second ring area A2.

Figure 7:
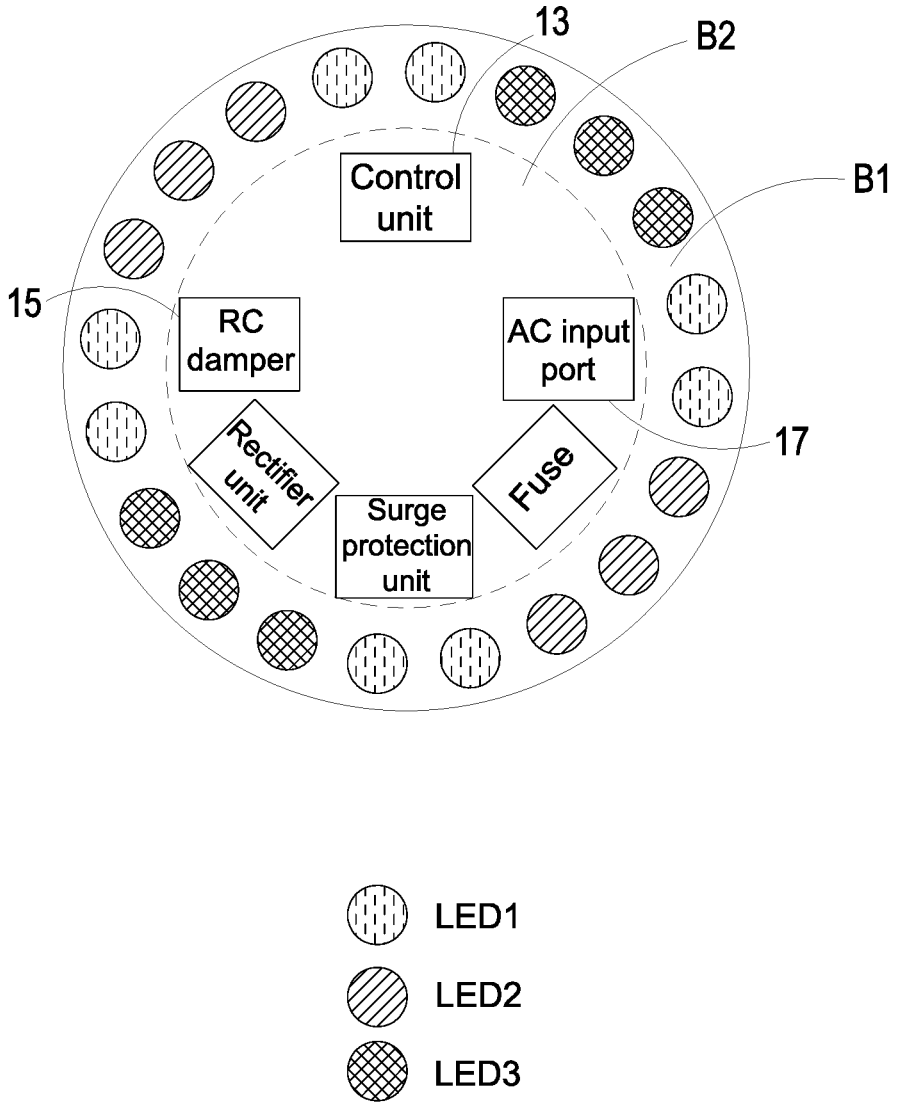
FIG. 7 is a schematic view illustrating another exemplary arrangement of the circuit units and the LED strings of the LED lighting module of FIG. 1.

In another embodiment as shown in FIG. 7, the surface of the circuit board 16 is divided into two areas including first ring area B land second ring area B2. The second ring area B2 and the first ring area B1 are co-axial and sequentially arranged along the radial direction from the center to outside. The rectifier unit 12, the control unit 13, the surge protection unit Var, the fuse F1, the RC damper 15 and the AC input port 17 are disposed on the second ring area B2 and spaced apart with each other. The first LED string LED 1 including at least eight LED elements, the second LED string LED 2 including at least six LED elements and the third LED string LED 3 including at least six LED elements are disposed on the first ring area B1 and spaced apart with each other. More preferably, the first LED string LED 1, the second LED string LED 2 and the third LED string LED 3 are alternately arranged on the first ring area B1. Due to that the first LED string LED 1, the second LED string LED 2 and the third LED string LED 3 are disposed on the surface of the circuit board 16 with symmetrical and interspersed arrangement, the light emitted by the LED lighting module 1 is more uniform.

Figure 8:
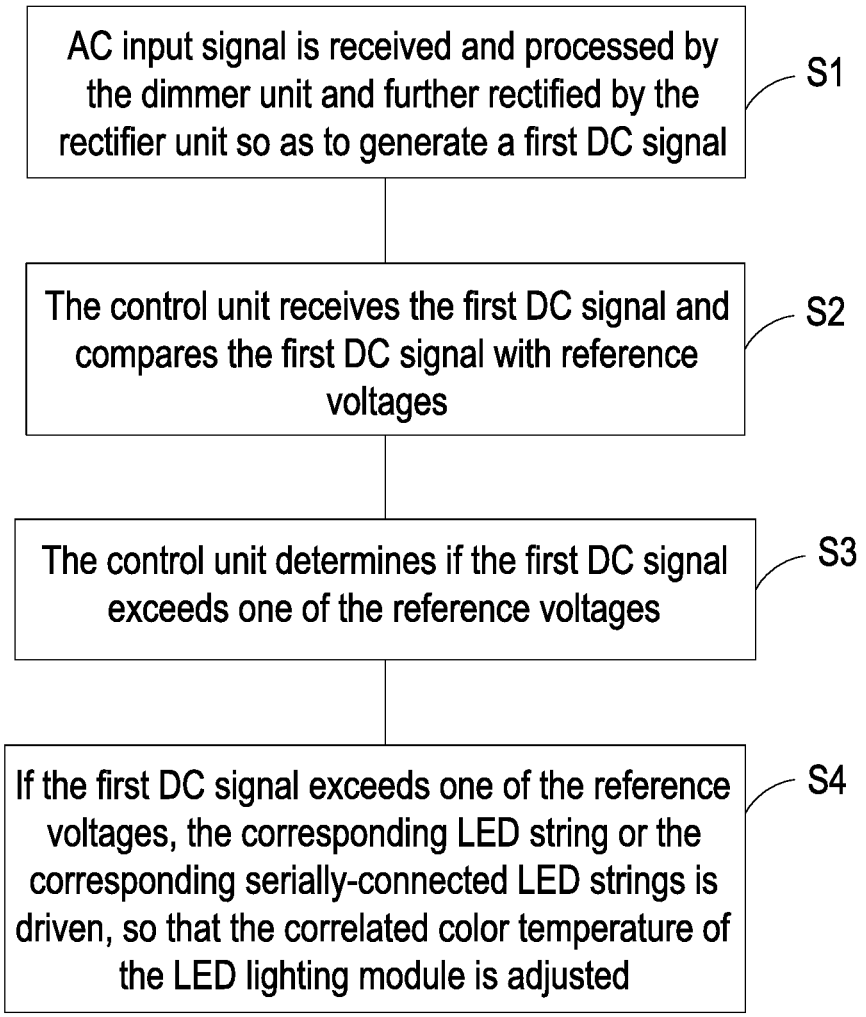
FIG. 8 shows a flowchart of the control method for performing a correlated color temperature adjustment by the LED lighting module according to an embodiment of the present invention.

FIG. 8 shows a flowchart of the control method for performing a correlated color temperature adjustment by the LED lighting module according to an embodiment of the present invention. The control method comprises the following steps. Firstly, an AC input signal is received and processed by the dimmer unit 11 and further rectified by the rectifier unit 12 so as to generate a first DC signal (see step S1). Then, the control unit 12 receives the first DC signal and compares the first DC signal with the reference voltages (see step S2). In an embodiment, the Nth reference voltage is the sum of the driven voltages from the first LED string LED 1 to Nth LED strings LED N, and the Nth reference voltage is larger than the (N−1)th reference voltage. Then, the control unit 12 determines if the first DC signal exceeds one of the reference voltages (see step S3). If the first DC signal exceeds one of the reference voltages, the corresponding LED string or the corresponding serially-connected LED strings is driven, so that the correlated color temperature of the LED lighting module is adjusted (see step S4).

Figure 9:
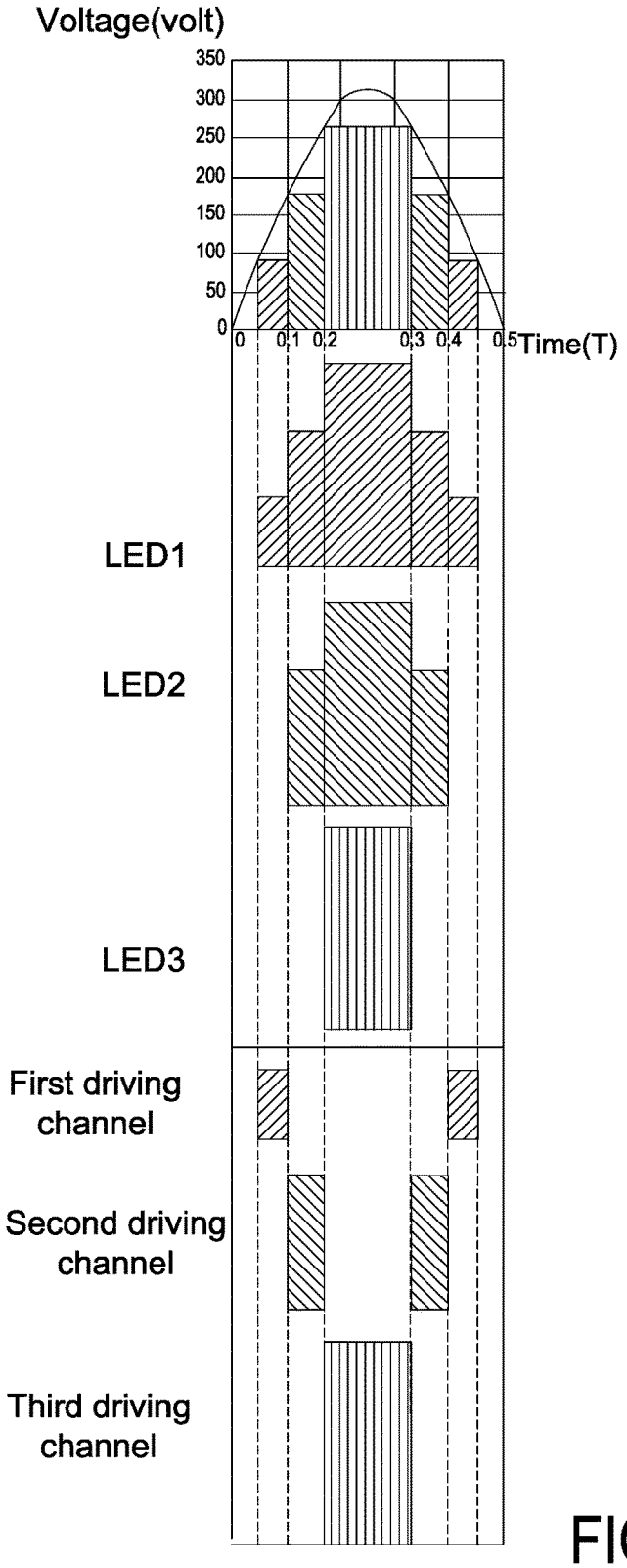
FIG. 9 shows a plot of voltage versus time of a AC waveform and having a superimpose plot illustrating driving times for three LED strings.

FIG. 9 shows a plot of voltage versus time of a AC waveform and having a superimpose plot illustrating driving times for three LED strings, where the horizontal axis indicates the time, the vertical axis indicates the magnitude of voltage and the line voltage is the first DC signal. As shown in FIGS. 2 and 9, the magnitude of the line voltage is varying with time. Moreover, as long as the line voltage (i.e. the first DC voltage) exceeds the Nth reference voltage, the Nth driving channel is enabled to drive the corresponding LED string or corresponding serially-connected LED strings.

In some embodiments, three LED strings are selectively driven by the first DC signal. However, more or less than three LED strings can be provided per apparatus and driven as described herein. As shown in FIG. 9, at the first time spot t1, the line voltage exceeds the first reference voltage, which is the driven voltage of the first LED string LED 1. Thus, the first LED string LED 1 is driven. At the second time spot t2, the line voltage exceeds the second reference voltage, which is the sum of the driven voltages from the first LED string LED 1 to the second LED string LED 2. Thus, the first LED string LED 1 and the second LED string LED 2 are driven. At third time spot t3, the line voltage exceeds the third reference voltage, which is the sum of the driven voltages from the first LED string LED 1 to the three LED string LED 3. Thus, all of the first LED string LED 1, the second LED string LED 2 and the third LED string LED 3 are driven. At the fourth time spot t4, the line voltage is lower than the third reference voltage and exceeds the second reference voltage. Thus, the third LED string LED 3 is turned off, and the first LED string LED 1 and the second LED string LED 2 are driven. At the fifth time spot t5, the line voltage is lower than the second reference voltage and exceeds the first reference voltage. Thus, the third LED string LED 3 and the second LED string LED 2 are turned off, and the first LED string LED 1 is driven. At the sixth time spot t6, the line voltage is lower than the first reference voltage. Thus, all of the third LED string LED 3, the second LED string LED 2 and the first LED string LED 1 are turned off.

In some embodiments, the dimmer unit 11 employs a TRIAC circuit for performing a dimming operation. The TRIAC circuit receives an AC input signal, and generates a phase-cut signal. If the phase-cut line voltage only includes the component that can drive the first LED string LED 1, the first LED string LED 1 is driven. If the phase-cut line voltage only includes the component of line voltage that can drive the first LED string LED 1 and the second LED string LED 2 in series, only the first LED string LED 1 and the second LED string LED 2 are driven. If the phase-cut line voltage includes the component of line voltage that can drive the first LED string LED 1, the second LED string LED 2 and the third LED string LED 3, all of the first LED string LED 1, the second LED string LED 2 and the third LED string LED 3 are driven.

Figure 10:
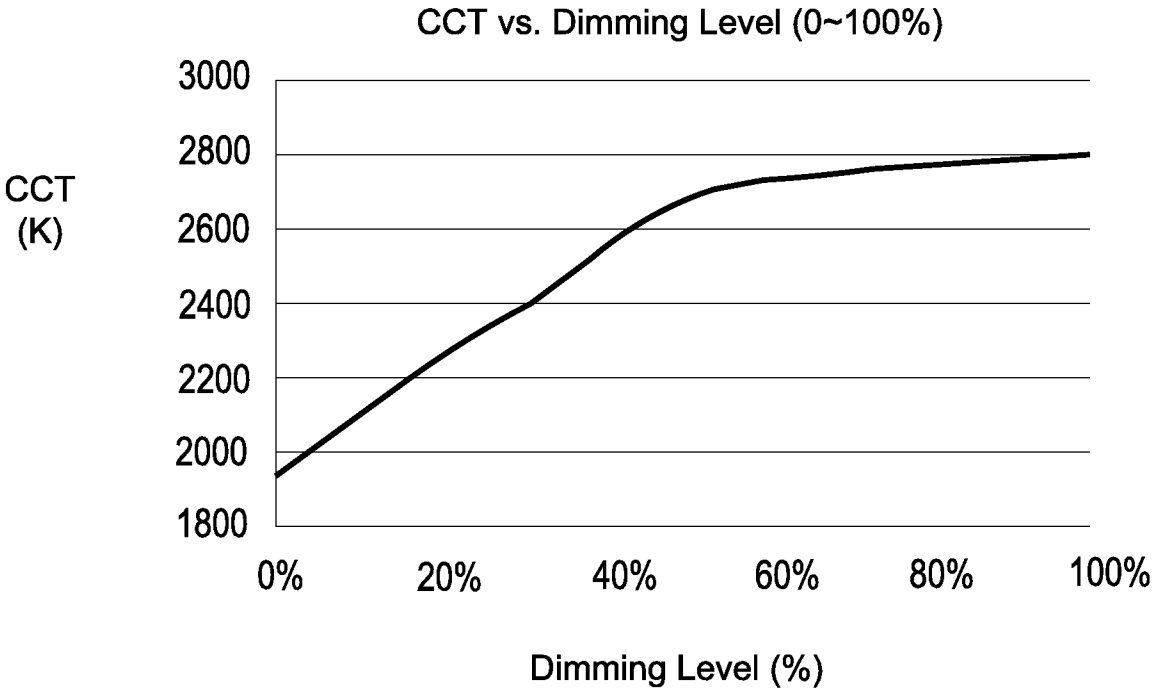
FIG. 10 is a diagram showing the correlated color temperature versus the dimming level by using the LED lighting module with an exemplary LED strings.

In some embodiments, the first string LED 1 has the predetermined correlated color temperature value of approximately 1900K, the second string LED 2 has the predetermined correlated color temperature value of approximately 3000K, and the third string LED 3 has the predetermined correlated color temperature value of approximately 4000K. The predetermined correlated color temperature value of the first LED string LED 1 is lower than that of the second LED string LED 2, and the predetermined correlated color temperature value of the second LED string LED 2 is lower than that of the third LED string LED 3. Consequently, the specific correlated color temperature value ranged from 1900K to 2700K is adjusted and generated by mixing the light emitted from the three LED strings. FIG. 10 is a diagram showing the correlated color temperature value versus the dimming level by using the LED lighting module with an exemplary LED strings. The horizontal axis indicates the percentage of the dimming level, and the vertical axis indicates the correlated color temperature value of the LED lighting module. When the percentage of the dimming level is raised, the component of phase-cut of line voltage is changed correspondingly for driving the corresponding LED strings. Thus, when the percentage of the dimming level is raised gradually, the correlated color temperature value of the LED lighting module 1 will be raised from 1900K to 2700K by mixing the predetermined correlated color temperature values of the driven LED strings.

Figure 11:
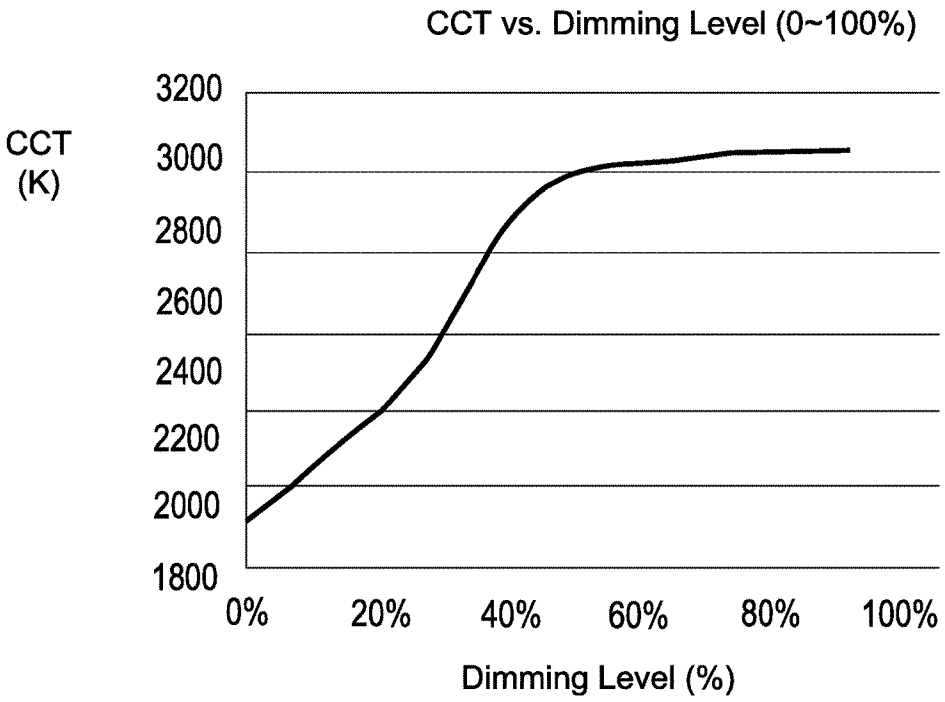
FIG. 11 is a diagram showing the correlated color temperature versus the dimming level by using the LED lighting module with another exemplary LED strings.

In some embodiments, the first string LED 1 has the predetermined correlated color temperature value of approximately 1900K, the second LED string LED 2 has the predetermined correlated color temperature value of approximately 4000K, and the third LED string LED 3 has the predetermined correlated color temperature value of approximately 5000K. The predetermined correlated color temperature value of the first LED string LED 1 is lower than that of the second LED string LED 2, and the predetermined correlated color temperature value of the second LED string LED 2 is lower than that of the third LED string LED 3. Consequently, the specific correlated color temperature value ranged from 1900K to 3000K is adjusted and generated by mixing the light emitted from the three LED strings. FIG. 11 is a simulation resulting diagram showing the correlated color temperature value versus the dimming level by using the LED lighting module with another exemplary LED strings. The horizontal axis indicates the percentage of the dimming level and the vertical axis indicates the correlated color temperature value of the LED lighting module 1. When the percentage of the dimming level is raised, the component of phase-cut of line voltage will be changed correspondingly for driving the corresponding LED strings. Thus, when percentage of the dimming level is raised gradually, the correlated color temperature value of the LED lighting module 1 will be raised from 1900K to 3000K by mixing the predetermined correlated color temperature values of the driven LED strings Moreover, the specific correlated color temperature value of the LED lighting module 1 is generated by mixing the predetermined correlated color temperature values of the driven LED strings. The specific correlated color temperature value of the LED lighting module 1 is located between the largest predetermined correlated color temperature value and the smallest predetermined correlated color temperature value of the driven LED strings. In an embodiment, the specific correlated color temperature value of the LED lighting module 1 is also related to the intensity. The LED lighting unit 14 includes three LED strings, i.e. a first LED string LED 1, a second LED string LED 2 and a third LED string LED 3. When the intensity of the light is the largest one, which means all of the first LED string LED 1, the second LED string LED 2 and the third LED string LED 3 are driven, the specific correlated color temperature value of the LED lighting module 1 is located between the largest predetermined correlated color temperature value and the smallest predetermined correlated color temperature value of the first LED string LED 1, the second LED string LED 2 and the third LED string LED 3. When the intensity of the light is the smallest one, which means only the first LED string LED 1 is driven, the specific correlated color temperature value of the LED lighting module 1 is equaled to the predetermined correlated color temperature value of the first LED string LED 1.

Figure 12:
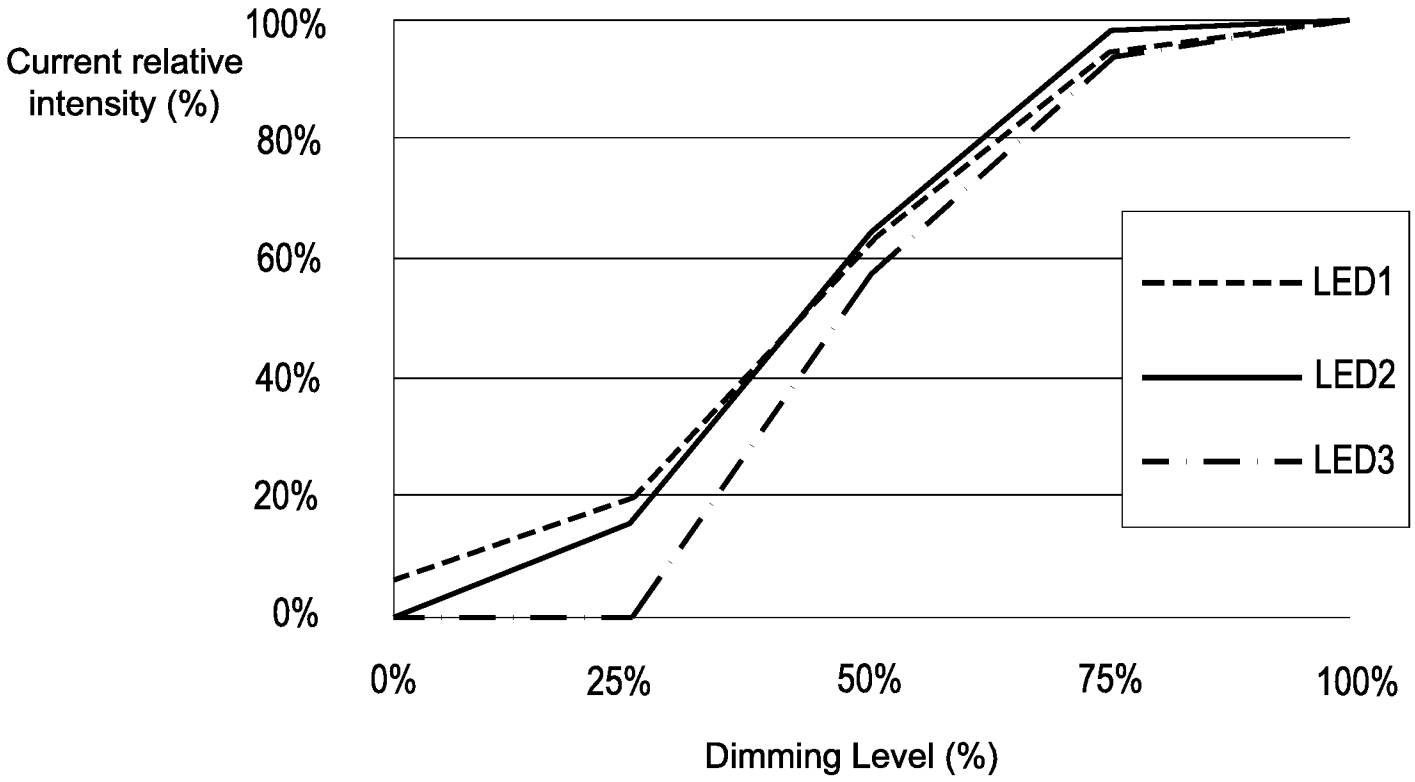
FIG. 12 is a diagram showing the intensity versus the dimming level by using the LED lighting module of the present invention.

FIG. 12 is a diagram showing the intensity versus the dimming level by using the LED lighting module of the present invention. As shown in FIG. 12, the x axis indicates the percentage of the dimming level and the y axis indicates the percentage of the intensity. When the first DC signal, which is adjusted by a specific percentage of the dimming level, exceeds the Nth reference voltage, the corresponding LED string or the corresponding serially-connected LED strings is driven to generate the corresponding percentage of the intensity. When the percentage of the dimming level exceeds 25%, all of the first LED string LED 1, the second LED string LED 2 and the third LED string LED 3 are driven. In addition, because of the amounts of the current is in directly proportional to the percentage of the dimming level, and the amounts of the current is in directly proportional to the intensity, the percentage of the dimming level is in directly proportional to the intensity.

In conclusion, the present invention provides an LED lighting module having tunable correlated color temperature and control method thereof. By using the inventive LED lighting module, there is no need to employ a complicated and high-cost processor to control LED strings, so that the cost of production is decreased. In addition, the inventive LED lighting module is dimmable and the color temperature of the light emitted by the inventive LED lighting module is adjusted according to the comparing results between the line voltage and the reference voltages. Consequently, the circuit topology and the control method of the inventive LED lighting module are simple and applicable for various indoor lighting fixtures. Furthermore, the LED strings having at least two different predetermined correlated color temperature values are disposed on the surface of the circuit board with symmetrical and interspersed arrangement, so that the light emitted by the LED lighting module is more uniform.

While the invention has been described in terms of what are presently considered to be the most practical and preferred embodiments, it is to be understood that the invention need not be restricted to the disclosed embodiment. On the contrary, it is intended to cover various modifications and similar arrangements included within the spirit and scope of the appended claims which are to be accorded with the broadest interpretation so as to encompass all such modifications and similar structures. Therefore, the above description and illustration should not be taken as limiting the scope of the invention which is defined by the appended claims.

What is claimed is:

1. An LED lighting module having tunable correlated color temperature, comprising:

a dimmer unit configured to receive an AC input signal and convert the AC input signal into a first AC signal;

a rectifier unit electrically connected with an output of the dimmer unit and configured to receive the first AC signal and convert the first AC signal into a first DC signal;

an LED lighting unit electrically connected with the rectifier unit and configured to receive the first DC signal, wherein the LED lighting unit comprises a plurality of serially-connected LED strings, each of the LED strings has a predetermined correlated color temperature, and the plurality of LED strings have at least two different correlated color temperatures, wherein the plurality of LED strings include N LED strings from a first LED string to an Nth LED string, N is a positive integer greater than 2, and each of the N LED strings has a specific driven voltage; and a control unit electrically connected with the rectifier unit, the LED lighting unit and a ground point, and configured to receive the first DC signal and control current flowing through the plurality of serially-connected LED strings based on a comparison between the first DC signal and a reference voltage for each of the N LED strings, wherein the reference voltage for the particular one of the N LED strings equals the sum of the specific driven voltage of the particular LED string and the specific driven voltage of each LED string that precedes the particular LED string in the LED lighting unit;

wherein when the first DC signal exceeds the reference voltage for the particular one of the N LED strings, the control unit causes the particular LED string and each preceding LED string to be driven, whereas when the first DC signal does not exceed the reference voltage for a particular one of the N LED strings, the control unit prevents the particular LED string and any subsequent LED string from being driven.

2. The LED lighting module according to claim 1, wherein the dimmer unit includes a TRIAC circuit.

3. The LED lighting module according to claim 1, wherein the rectifier unit includes a full-bridge circuit.

4. The LED lighting module according to claim 1, wherein the control unit comprises a control circuit and the control circuit comprises an output channel electrically connected to the rectifier unit for outputting the first DC signal.

5. The LED lighting module according to claim 4, wherein the control circuit includes N driving channels including a first driving channel to an Nth driving channel, wherein the first driving channel is electrically connected to a node between the first LED string and the second LED string, the (N−1)th driving channel is electrically connected to a node between the (N−1)th LED string and the Nth LED string, and the Nth driving channel is electrically connected to one terminal of the Nth LED string, wherein the Nth driving channel is configured to drive the corresponding serially-connected LED strings from the first LED string to the Nth LED string.

6. The LED lighting module according to claim 1, wherein the control unit comprises a plurality of control circuits and a switch circuit, wherein the plurality of control circuits comprises N control circuits including a first control circuit to an Nth control circuit, the switch circuit is configured to receive the first DC signal to drive the plurality of control circuits.

7. The LED lighting module according to claim 6, wherein the control unit comprises N control circuits including a first control circuit to Nth control circuit, wherein each of the plurality of control circuits includes a first driving channel, a second driving channel and an output channel, wherein the first driving channel of the first control circuit is electrically connected to a node between the first LED string and the second LED string, the second driving channel of the first control circuit is electrically connected to one terminal of the second LED string, wherein the first driving channel of the (N−1)th control circuit is electrically connected to the output channel of the (N−2)th control circuit and one terminal of the Nth LED string, and the second driving channel of the (N−1)th control circuit is electrically connected to the other terminal of the Nth LED string, wherein the first driving channel of the Nth control circuit is electrically connected to the output channel of the (N−1)th control circuit through the switch circuit.

8. The LED lighting module according to claim 1, further comprising a circuit board, wherein the rectifier unit, the LED lighting unit and the control unit are disposed on a surface of the circuit board.

9. The LED lighting module according to claim 8, wherein all of the plurality of LED strings are disposed on the same surface of the circuit board, wherein the circuit board are divided into a first ring area, a second ring area and a third ring area, wherein the rectifier unit and the control unit are disposed on the first ring area, at least one LED string of the plurality of LED strings is disposed on the third ring area, and the other LED strings of the plurality of LED strings are disposed on the second ring area.

10. The LED lighting module according to claim 8, wherein all of the plurality of LED strings are disposed on the same surface of the circuit board, and the circuit board are divided into a first ring area and a second ring area, wherein the rectifier unit and the control unit are disposed on the second ring area, and the plurality of LED strings are disposed on the first ring area.

11. The LED lighting module according to claim 8, wherein the plurality of LED strings having at least two different predetermined correlated color temperatures are disposed on the surface of the circuit board with symmetrical and interspersed arrangement.

12. The LED lighting module according to claim 1, wherein the plurality of LED strings comprises the first LED string, the second LED string and the third LED string, wherein the predetermined correlated color temperature value of the first LED string is 1900K, the predetermined correlated color temperature value of the second LED string is 3000K, the predetermined correlated color temperature value of the third LED string is 4000K, and the correlated color temperature of the LED lighting module is ranged from 1900K to 2700K.

13. The LED lighting module according to claim 1, wherein the plurality of LED strings comprises the first LED string, the second LED string and the third LED string, wherein the predetermined correlated color temperature value of the first LED string is 1900K, the predetermined correlated color temperature value of the second LED string is 4000K, the predetermined correlated color temperature value of the third LED string is 5000K, and the correlated color temperature of the LED lighting module is ranged from 1900K to 3000K.

14. The LED lighting module according to claim 1, wherein the correlated color temperature of the light emitted by the LED lighting module is located between a largest predetermined correlated color temperature value and a smallest predetermined correlated color temperature value of the driven LED strings.

15. A control method for performing a correlated color temperature adjustment comprising:

(a) receiving, at an LED lighting module, and AC voltage signal, the LED lighting module comprising a dimmer unit, a rectifier unit, a control unit and an LED lighting unit, the LED lighting unit including a plurality of serially-connected LED strings, each of the LED strings having a predetermined correlated color temperature, the plurality of LED strings having at least two different correlated color temperatures, wherein the plurality of LED strings include N LED strings from a first LED string to an Nth LED string, N is a positive integer greater than 2, and each of the N LED strings has a specific driven voltage and an associated reference voltage, wherein the reference voltage for the particular N LED strings equals the sum of the specific driven voltage of the particular LED string and the specific driven voltage of each LED string that precedes the particular LED string in the LED lighting unit;

(b) converting the AC input signal into a first AC signal by the dimmer unit;

(c) receiving the first AC signal and converting the first AC signal into a first DC signal by the rectifier unit; and (d) when the first DC signal exceeds the reference voltage for the particular one of the N LED strings, causing, by the control unit, the particular LED string and each preceding LED string to be driven, whereas when the first DC signal does not exceed the reference voltage for a particular one of the N LED strings, preventing, by the control unit, the particular LED string and any subsequent LED string from being driven.

* * * * *